US010190557B2

(12) United States Patent
Roseborsky et al.

(10) Patent No.: US 10,190,557 B2
(45) Date of Patent: Jan. 29, 2019

(54) FUEL INJECTOR MOUNTING DEVICE AND FUEL RAIL

(71) Applicants: DENSO International America, Inc., Southfield, MI (US); DENSO CORPORATION, Kariya, Aichi-pref. (JP)

(72) Inventors: Steve Roseborsky, Kingsville (CA); Dhyana Ramamurthy, Novi, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 51 days.

(21) Appl. No.: 14/852,999

(22) Filed: Sep. 14, 2015

(65) Prior Publication Data

US 2017/0074223 A1 Mar. 16, 2017

(51) Int. Cl.

| | |
|---|---|
| ***F02M 61/14*** | (2006.01) |
| ***F02M 55/04*** | (2006.01) |
| ***F02M 63/02*** | (2006.01) |
| ***F02M 69/46*** | (2006.01) |
| *F02M 61/16* | (2006.01) |

(52) U.S. Cl.

CPC ..... *F02M 61/14* (2013.01); *F02M 55/04* (2013.01); *F02M 63/0225* (2013.01); *F02M 69/465* (2013.01); *F02M 61/167* (2013.01); *F02M 61/168* (2013.01); *F02M 2200/853* (2013.01); *F02M 2200/855* (2013.01); *F02M 2200/856* (2013.01); *F02M 2200/857* (2013.01)

(58) Field of Classification Search

CPC ..... F02M 2200/85; F02M 2200/853; F02M 2200/855; F02M 2200/856; F02M 2200/857

USPC ..... 123/195 A, 470

See application file for complete search history.

(56) References Cited

U.S. PATENT DOCUMENTS

| | | | | |
|---|---|---|---|---|
| 7,703,421 | B2 * | 4/2010 | Merchant | F01P 3/16 123/41.31 |
| 7,735,909 | B2 * | 6/2010 | Satou | B62D 25/20 280/781 |
| 8,826,890 | B2 | 9/2014 | Sato | |
| 9,103,308 | B2 * | 8/2015 | Serra | F02M 55/025 |
| 9,441,591 | B2 * | 9/2016 | Ramamurthy | F02M 61/14 |
| 2004/0118382 | A1 * | 6/2004 | Usui | F02M 55/004 123/456 |
| 2005/0183688 | A1 * | 8/2005 | Kostecki | F02M 19/00 123/195 A |

(Continued)

FOREIGN PATENT DOCUMENTS

| | | |
|---|---|---|
| EP | 2902617 A1 | 8/2015 |
| GB | 2138887 A | 10/1984 |

(Continued)

*Primary Examiner* — Sizo Vilakazi
*Assistant Examiner* — Kevin R Steckbauer
(74) *Attorney, Agent, or Firm* — Harness, Dickey & Pierce, P.L.C.

(57) ABSTRACT

A cup is in a bottomed tubular shape to receive an injector along an injector axis. A bracket is extended from a sidewall of the cup. The bracket includes at least one arm and a body. The at least one arm connects the body with the cup. The body forms a screw opening configured to receive a screw along a screw axis. The body has a pivot end on an opposite side of the screw axis from the injector axis.

15 Claims, 10 Drawing Sheets

(56) References Cited

U.S. PATENT DOCUMENTS

| | | | | |
|---|---|---|---|---|
| 2007/0290525 | A1* | 12/2007 | Satou | B62D 21/00 296/203.01 |
| 2010/0024746 | A1* | 2/2010 | Merchant | F01P 3/16 123/41.42 |
| 2012/0060798 | A1* | 3/2012 | Sato | F02M 55/02 123/470 |
| 2012/0280067 | A1* | 11/2012 | Serra | F02M 55/025 239/533.2 |
| 2013/0284152 | A1* | 10/2013 | Fischer | F02M 55/025 123/470 |
| 2014/0261332 | A1* | 9/2014 | Ramamurthy | F02M 61/14 123/470 |
| 2015/0075496 | A1* | 3/2015 | Pasquali | F02M 61/14 123/469 |
| 2016/0319787 | A1* | 11/2016 | Udagawa | F02M 55/004 |

FOREIGN PATENT DOCUMENTS

| | | | | |
|---|---|---|---|---|
| GB | 2149842 | A * | 6/1985 | F02M 61/14 |
| JP | S59-200062 | A | 11/1984 | |
| JP | 2010-275940 | A | 12/2010 | |
| JP | 2015-140783 | A | 8/2015 | |

* cited by examiner

FUEL INJECTOR MOUNTING DEVICE AND FUEL RAIL

TECHNICAL FIELD

The present disclosure relates to a fuel injector mounting device. The present disclosure further relates to a fuel rail equipped with the fuel injector mounting device.

BACKGROUND

Conventionally, a fuel rail may be equipped to an internal combustion engine. A fuel rail may be equipped with a fuel injector to inject fuel into a combustion chamber of an engine. A fuel rail may employ a structure to receive a fuel injector.

SUMMARY

According to an aspect of the preset disclosure, a cup may be in a bottomed tubular shape and may be configured to receive an injector along an injector axis. A bracket may be extended from a sidewall of the cup. The bracket may include at least one arm and a body. The at least one arm may connect the body with the cup. The body may form a screw opening configured to receive a screw along a screw axis. The body may have a pivot end on an opposite side of the screw axis from the injector axis.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

As follows, a first embodiment of the present disclosure will be described with reference to drawings. In the description, a vertical direction is along an arrow represented by "VERTICAL" in drawing(s). An axial direction is along an arrow represented by "AXIAL" in drawing(s). A longitudinal direction is along an arrow represented by "LONGITUDINAL" in drawing(s). A width direction is along an arrow represented by "WIDTH" in drawing(s). A radial direction is along an arrow represented by "RADIAL" in drawing(s). A circumferential direction is along an arrow represented by "CIRCUMFERENTIAL" in drawing(s).

Figure 1:
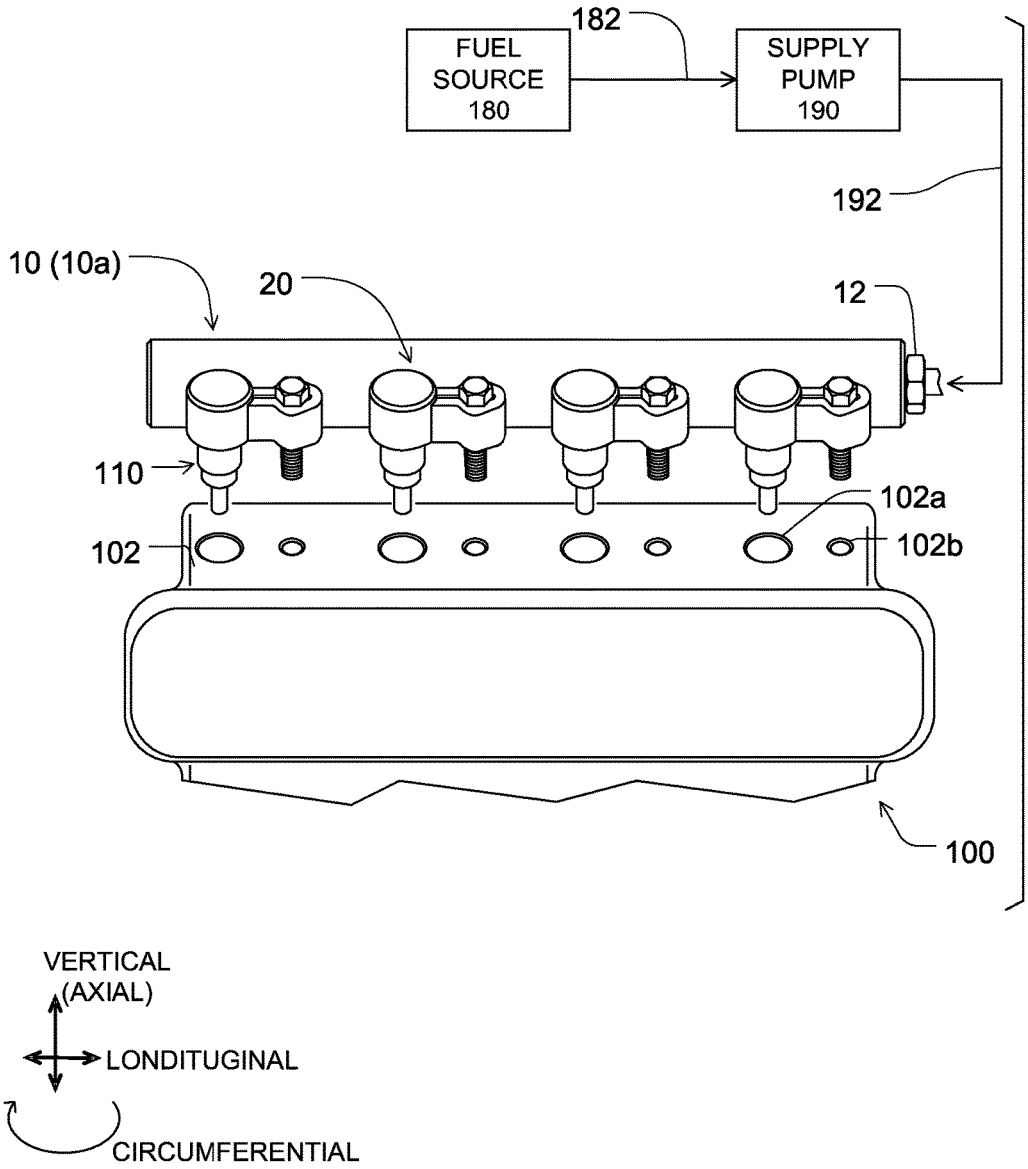
FIG. 1 is a perspective view showing a fuel rail equipped with injector mounting devices and a cylinder head of an engine.

As shown in FIG. 1, an internal combustion engine 100 is equipped with a fuel rail (rail body) 10 equipped with injectors 110. The fuel rail 10 has a fuel inlet 12 and defines a fuel passage 10*a* therein. The fuel inlet 12 may be coupled with a supply pump 190 and a fuel source 180 through pipes 182 and 192. The fuel source 180 may include a fuel tank and a feed pump (not shown). The supply pump 190 may draw fuel from the fuel source 180 and may pressurize the drawn fuel to supply the pressurized fuel through the fuel inlet 12 into the fuel passage 10*a*. The fuel rail 10 is equipped with the injectors 110 and is mounted onto a cylinder head 102 of the internal combustion engine 100. The fuel rail 10 is equipped with injector mounting devices 20. Specifically, the injector mounting devices 20 are mounted with injectors 110 and fasteners such as screws 160, respectively. The injectors 110 are fitted into injector holes 102*a* of the cylinder head 102. The fuel rail 10 may be affixed to the cylinder head 102 of the engine 100 by screwing the screws 160 through the injector mounting devices 20 into screw holes 102*b* of the cylinder head 102. In the example, the engine 100 may be a four-cylinder engine 100, and the fuel rail 10 may be equipped with four injectors 110 via four injector mounting devices 20, respectively.

FIGS. 2 to 5 show one of the injector mounting devices 20. The injector mounting device 20 includes a cup 40 and a bracket 50.

Figure 2:
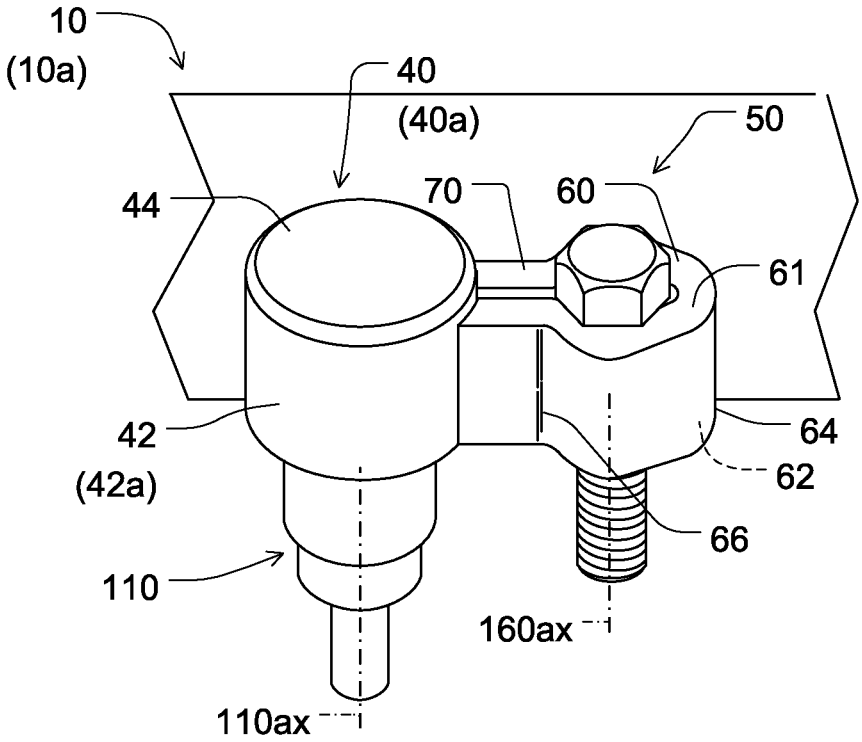
FIG. 2 is a perspective view showing the injector mounting device equipped with a fuel injector and a screw.
Figure 2:
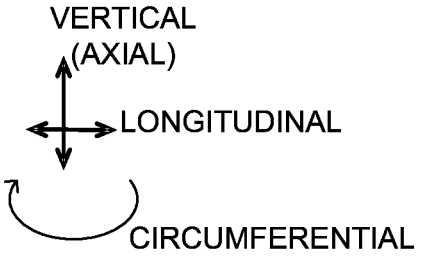

In FIG. 2, the cup 40 may be in a bottomed tubular shape including a sidewall 42 and a bottom end 44. The sidewall 42 may be in a tubular shape, and the bottom end 44 may be in a disc shape. The sidewall 42 and the bottom end 44 of the cup 40 may be integrally formed as a monolithic one piece to define an internal space 40*a*. The cup 40 may be formed of metal such as stainless steel by, for example, forging and/or machining. The cup 40 may have an inlet 44*a* as a through hole in the sidewall 42. The internal space 40*a* of the cup 40 is communicated with the fuel passage 10*a* of the fuel rail 10 through the inlet 44*a*. The cup 40 is configured to receive the injector 110. The cup 40 may define an injector axis 110*ax*. When the cup 40 receives the injector 110, the injector 110 may be aligned with the injector axis 110*ax*.

The bracket 50 may be extended from the sidewall 42 of the cup 40 along the longitudinal direction of the fuel rail 10. The bracket 50 may be formed of metal such as stainless steel by, for example, forging and/or machining. The bracket 50 may be may be integrally formed as a monolithic one piece. The bracket 50 may include a body 60 and two arms 70. The arms 70 connect the body 60 of the bracket 50 with the cup 40. The body 60 forms a screw opening 60*a* configured to receive the screw 160. When the screw opening 60*a* receives the screw 160, the screw 160 may be aligned along a screw axis 160*ax*. In the present example, the screw axis 160*ax* and the injector axis 110*ax* may be in parallel with each other.

The body 60 may have a top surface 61 and a bottom surface 62 each being a flat surface. The top surface 61 and the bottom surface 62 may be in parallel with each other. The body 60 has a pivot end 64 on the opposite side of the screw axis 160*ax* from an arm-side ends 66.

Figure 3:
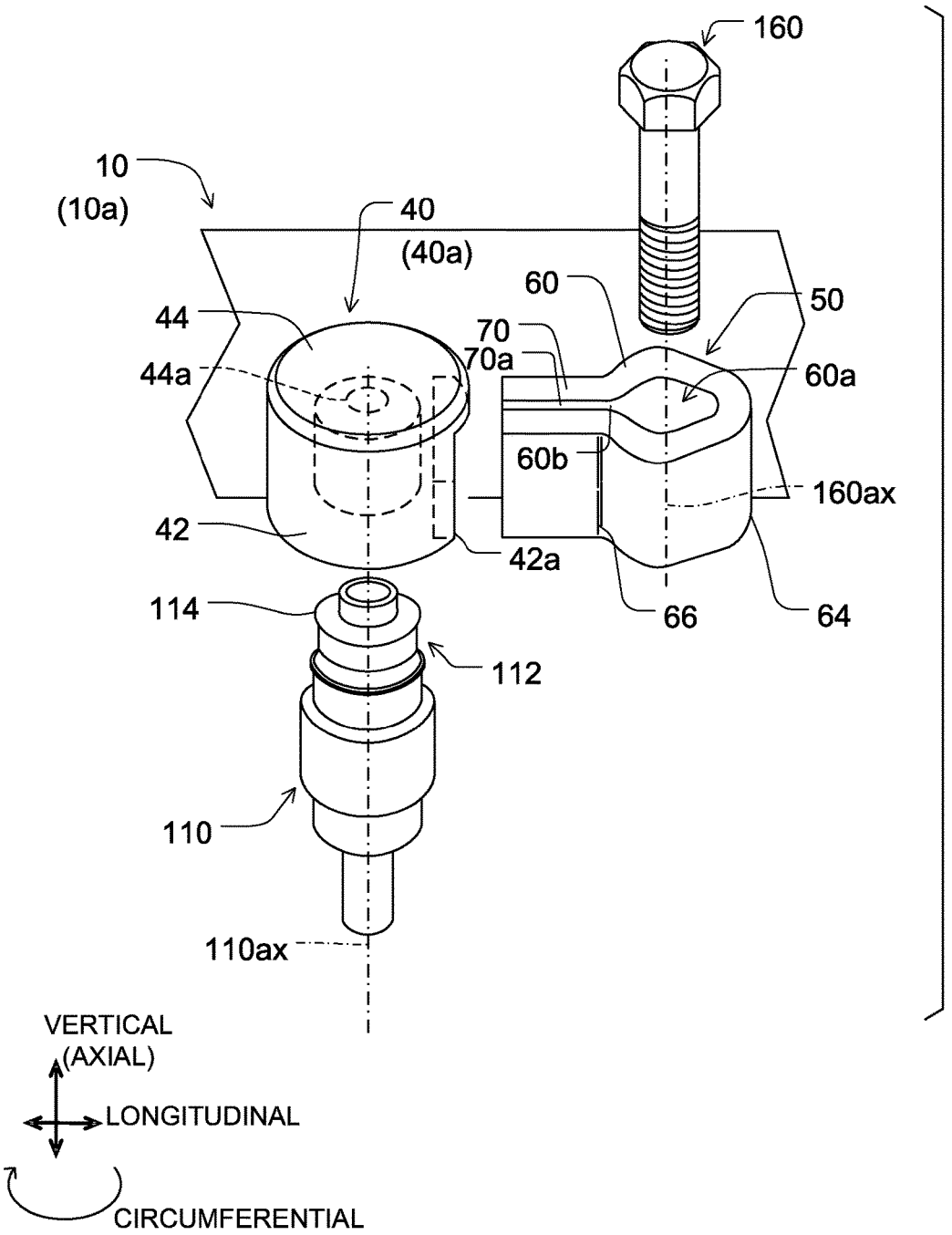
FIG. 3 is an exploded perspective view showing a cup and a bracket of the injector mounting device.

FIG. 3 shows the components before being assembled together. In FIG. 3, the arms 70 may define a gap 70*a* therebetween. The body 60 may be in a C-shape having the arm-side ends 66 connected with the arms 70 respectively. The body 60 may be in a partial tubular shape having a notch opening 60*b* to form a C-shaped section. Each of the arms 70 may be in a plate shape. The arms 70 may extend from the arm-side ends 66 of the body 60 to form the gap 70*a* extending from the notch opening 60*b*.

In FIG. 3, the sidewall 42 of the cup 40 may have a key slot 42*a*. The key slot 42*a* may be in a rectangular shape corresponding to the outer shape of one ends of the arms 70. The key slot 42*a* may be dented radially inward from the surface of the sidewall 42. The key slot 42*a* may be formed by machining such as cutting the sidewall 42 radially inward. The key slot 42*a* may receive the one ends of the arms 70. Specifically, the one ends of the arms 70 may be fitted to the key slot 42*a* of the cup 40. Thus, the bracket 50 may be connected with the sidewall 42 of the cup 40 to be extended from the sidewall 42 of the cup 40. The bracket 50 may be fixed to the cup 40 by, for example, brazing.

The injector 110 may have a fuel inlet end 112 to be seated within the internal space 40*a* of the cup 40. The fuel inlet end 112 may be equipped with an O-ring 114 to seal between the fuel inlet end 112 of the injector 110 and the inner periphery of the sidewall 42 of the cup 40 thereby to restrict fuel from leaking out from the internal space 40*a* of the cup 40. The sidewall 42 of the cup 40 may have a dimension to receive the fuel inlet end 112 of the injector 110 such that the fuel inlet end 112 of the injector 110 abuts the inner periphery of the sidewall 42 of the cup 40. In this way, the cup 40 may align the injector 110 along the injector axis 110*ax*. The injector axis 110*ax* may extend through an axial center of both the cup 40 and the injector 110, when the cup 40 receives the injector 110.

Figure 4:
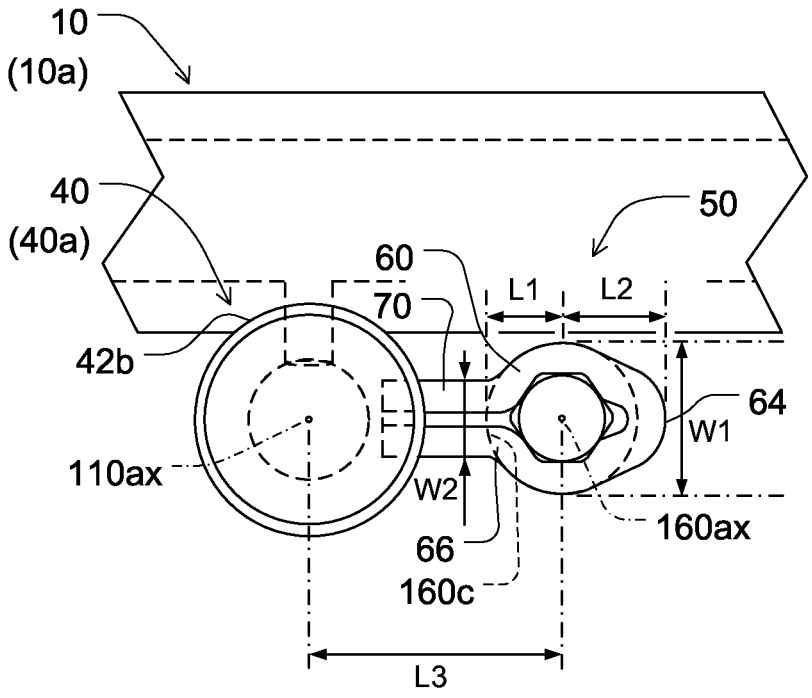
FIG. 4 is a top view showing the fuel rail equipped with the injector mounting device.
Figure 4:
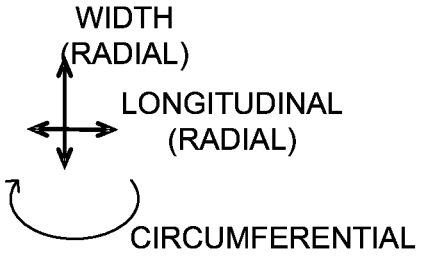

In FIG. 4, the cup 40 may have a curved dent 42*b* via which the cup 40 may be affixed to the surface of the fuel rail 10 by, for example, brazing.

The bracket 50 may be in a U-shape. The U-shape may include an Ω-shape (Omega-shape) in which a body width W1 of the body 60 is greater than an arm width W2, which corresponds to the outer dimension of the arms 70. That is, the bracket 50 may be narrowed at the arms 70 relative to the body 60.

The U-shape may include a literally U-shape in which the body width W1 of the body 60 is the same as the arm width W2, which corresponds to the outer dimension of the arms 70. That is, the bracket 50 may be in a straight and round shape in which the arms 70 extend linearly to the body 60 without a narrowed portion.

In the example, the body 60 may be asymmetric relative to the screw axis 160*ax* in the longitudinal direction.

The body 60 may have an arc periphery in an arc shape on the side of the arm-side end 66. The arc periphery of the body 60 may extend along an imaginary circle 160*c*, which is coaxial with the screw axis 160*ax*. The imaginary circle 160*c* may inscribe the arc periphery of the body 60 or may circumscribe the arc periphery of the body 60. The screw axis 160*ax* may be at a distance L1 from the arm-side end 66. More specifically, the arm-side end 66 may be located on an end of the imaginary circle 160*c* on the side of the arms 70. Therefore, the distance L1 may be between the screw axis 160*ax* and an end of the imaginary circle 160*c* on the side of the arm-side end 66. The screw axis 160*ax* may be at a distance L2 from the pivot end 64. The distance L2 may be greater than the distance L1.

The cup 40 may be cantilevered from the fuel rail 10 via the connection between the curved dent 42*b* of the cup 40 and the surface of the fuel rail 10. The cup 40 may be extended from the fuel rail 10 perpendicularly to the longitudinal direction of the fuel rail 10.

The body 60 of the bracket 50 may be cantilevered from the cup 40 via the arms 70. In the example, the bracket 50 may be indirectly supported by the fuel rail 10 via the cup 40. The bracket 50 may be extended from the cup 40 along the longitudinal direction of the fuel rail 10. The bracket 50 may be spaced from the surface of the fuel rail 10. In the example, the bracket 50 may be angled by 90 degrees twice relative to the longitudinal direction of the fuel rail 10.

Figure 5:
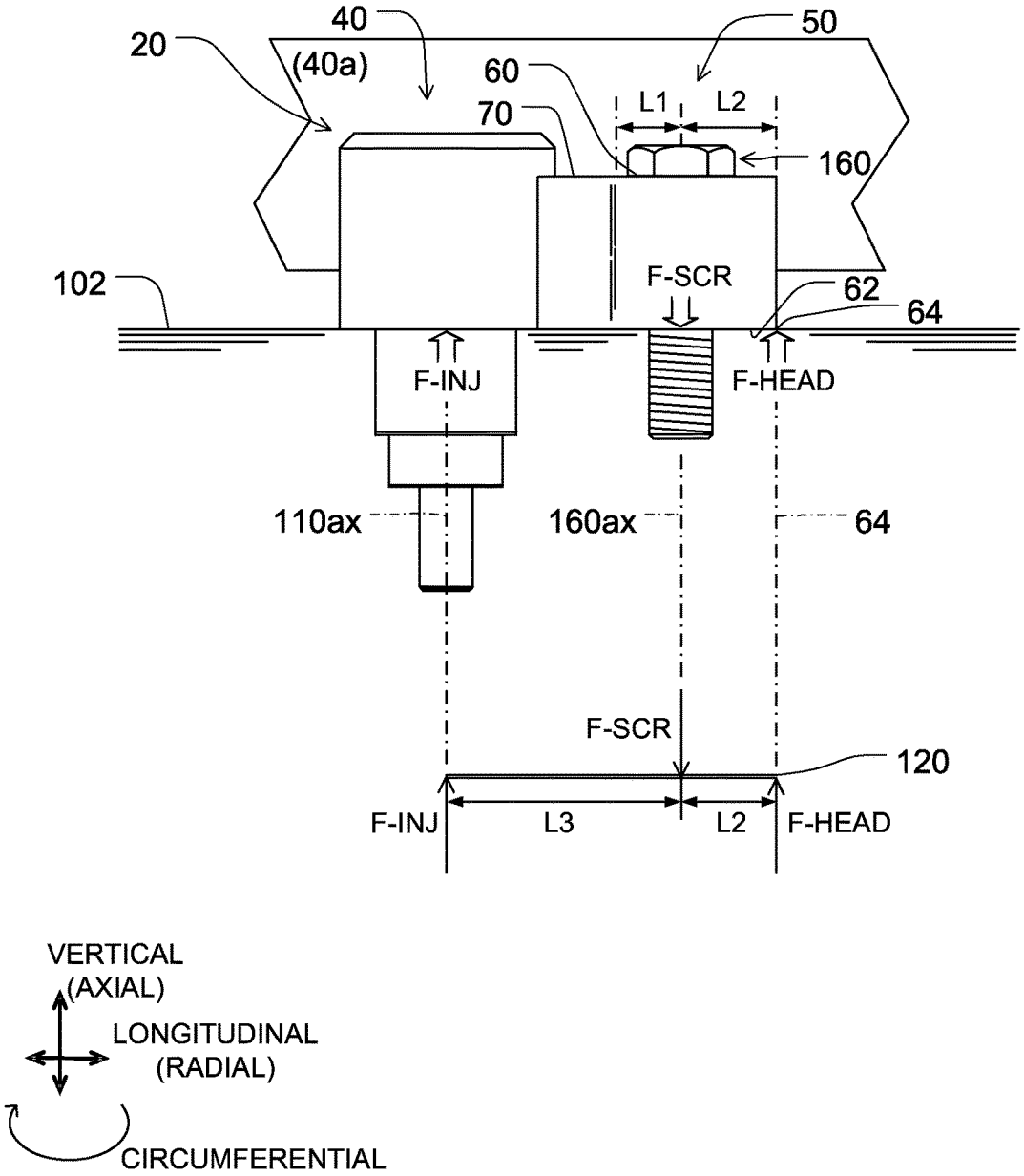
FIG. 5 is a side view showing the injector mounting device equipped with the fuel injector and the screw and mounted to the cylinder head of the engine.

In FIG. 5, the fuel rail 10 may be mounted on the cylinder head 102 of the engine 100 by inserting the screw 160 through the bracket 50 of the injector mounting device 20 and by fastening the screw 160 to the cylinder head 102. The injector 110 may be supported between the cylinder head 102 and the cup 40 of the injector 110. The bottom surface 62 of the bracket 50 may be faced to a flat surface of the cylinder head 102 of the engine 100. The pivot end 64 of the bracket 50 may be in contact with the flat surface the cylinder head 102.

In the state, the injector 110 is enabled to inject fuel into a combustion chamber of the engine 100. In this case, the injector 110 may inject fuel at high pressure into the combustion chamber within which fuel (fuel mixture) may be burned at high pressure. When the injector 110 injects fuel into the combustion chamber, the injector 110 may be applied with a reactive force F-INJ, which may act the cup 40 through the injector 110 upward in the drawing. Thus, the reactive force F-INJ may act the cup 40 through the injector 110 to raise the cup 40 to be away from the cylinder head 102. To the contrary, the screw 160 may apply a screw force F-SCR onto the bracket 50 downward in the drawing. Thus, the screw force F-SCR may act to hold down the cup 40 and the injector 110 toward the cylinder head 102 via the bracket 50.

The reactive force F-INJ may act to rotate the injector mounting device 20 in the clockwise direction about the pivot end 64, and to the contrary, the screw force F-SCR may act to rotate the injector mounting device 20 in the counterclockwise direction about the pivot end 64. In the state, the pivot end 64 may function as a pivot (fulcrum).

The cylinder head 102 may apply a reactive force F-HEAD onto the pivot end 64 in response to the reactive force F-INJ and the screw force F-SCR. In the state, the screw force F-SCR may be balanced to sum of the reactive force F-INJ and the screw force F-SCR.

In FIG. 5, the application of the forces onto the injector mounting device 20 is simplified with a beam on the lower side in the drawing. With respect to the screw axis 160*ax*, the reactive force F-INJ may apply a moment (F-INJ×L3) in the clockwise direction, and the reactive force F-HEAD may apply a moment (F-HEAD×L2) in the counterclockwise direction.

In the example, the body 60 may be asymmetrical relative to the screw axis 160*ax* in the longitudinal direction, and the distance L2 between the screw axis 160*ax* and the pivot end 64 is set to be greater than the distance L1 between the screw axis 160*ax* and the arm-side end 66. In this way, the pivot end 64 may be set to be farther away from the screw axis 160*ax*. As the distance L2 is set greater, the moment (F-HEAD×L2) may become greater accordingly. Therefore, the present example may enable to increase the moment (F-HEAD×L2) effectively by employing the asymmetric shape for the body 60 to set the distance L2 at a high value.

In the example, the bracket 50 may be cantilevered from the cup 40. The arms 70 may form the gap 70*a* therebetween. Thus, the bracket 50 may be less rigidly supported by the fuel rail 10. The entire structure of the fuel rail 10 and the injector mounting device 20 may permit to flex itself and may allow flexure and torsional deformation. The structure may enhance dimensional tolerance of the entire structure including the fuel rail 10 and the injector mounting devices 20 reactive to the cylinder head 102 of the engine 100.

Second Embodiment

Figure 6:
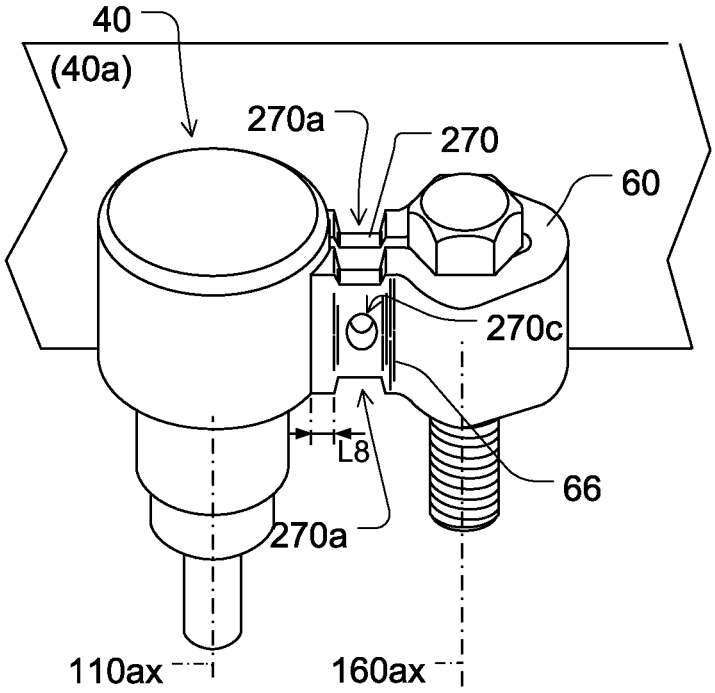
FIG. 6 is an exploded perspective view showing a cup and a bracket according to a second embodiment.
Figure 6:
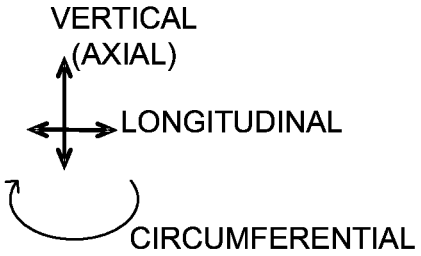

As shown in the example of FIG. 6, an arm 270 may be reduced in cross sectional area relative to the body 60. Specifically, the arm 270 may have cutout portions 270*a* on both side in the height direction, which may be along with the vertical direction. In this way, the arm 270 may be reduced in height in the height direction, compared with the height of the body 60. In addition or alternatively, the arm 270 may be reduced in width in the width direction, compared with the width of the body 60. In the example, each of the arms 270 may have a through hole 270*c* extending through the arm 270 in the width direction. In the example, the arm 270 may be reduced in rigidity to enhance flexure.

In the example, the cutout portions 270*a* may be distant from a connection between the bracket 50 and the cup 40 by a distance L8 to avoid stress concentration at the connection.

Third Embodiment

Figure 7:
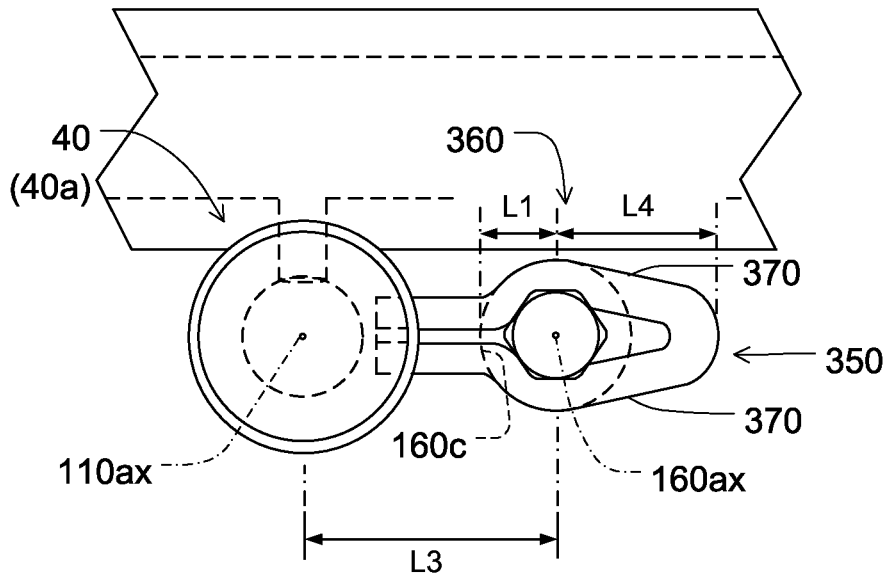
FIG. 7 is a top view showing the fuel rail equipped with the injector mounting device according to a third embodiment.
Figure 7:
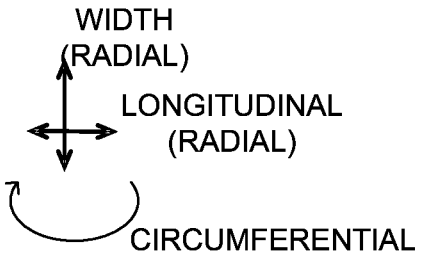

As shown in the example of FIG. 7, a body 360 of a bracket 350 is further asymmetric compared with the body 60 in the first embodiment. The body 360 may have extensions 370 further to elongate the body 360 on the side of the pivot end 64 in the longitudinal direction. Thus, the pivot end 64 may be positioned farther away from the screw axis 160*ax*. In the example, the screw axis 160*ax* is at a distance L4 from the pivot end 64. The distance L4 may be greater than the distance L2 (FIG. 4) in the first embodiment and may be further greater than the distance L1. The distance L1, the distance L3, and the distance L4 may have the following relation: $L1<L4\leq L3$.

Fourth Embodiment

Figure 8:
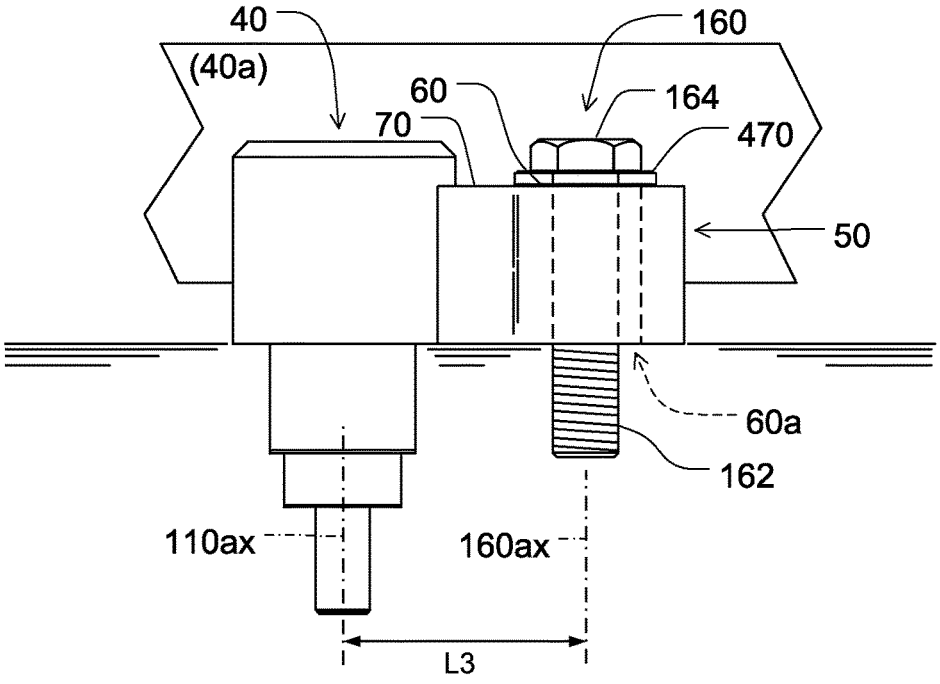
FIG. 8 is a side view showing the injector mounting device according to a fourth embodiment.
Figure 8:
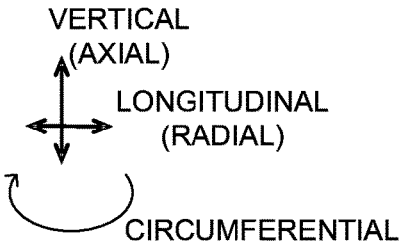

As shown in the example of FIG. 8, a positioner 470 may be equipped on the top surface 61 of the body 60 of the bracket 50. The positioner 470 may be formed by, for example, punching a metallic plate material to be in a ring shape. The positioner 470 may be joined to the bracket 50 by, for example, welding or brazing accurately to enable the positioner 470 to position the screw axis 160*ax* of the screw 160 at a predetermined position. The positioner 470 may have an inner aperture having an inner diameter, which is substantially the same as an outer diameter of a stud 162 of the screw 160. Specifically, the inner aperture of the positioner 470 may be slightly greater than the outer diameter of a stud 162 such that the inner aperture aligns the stud 162 substantially without play.

The configuration may enable the center axis of the positioner 470 to coincide with the longitudinal axis of the stud 162 of the screw 160. The configuration may enable to tightly control a tolerance of the inner aperture of the positioner 470 with respect to the screw 160. Alternatively, the inner diameter of the inner aperture of the positioner 470 may be greater than an outer diameter of the stud 162 of the screw 160. The positioner 470 may be configured to function as a washer.

The screw opening 60*a* of the body 60 may be formed greater than the size of the stud 162 of the screw 160 to enable the stud 162 to move within the screw opening 60*a*. The positioner 470 may enable a screw head 164 of the screw 160 to be seated on the positioner 470.

The distance L3 between the injector axis 110*ax* and the screw axis 160*ax* may vary due to dimensional tolerance of the components and deformation caused by, for example, thermal application caused by brazing. The positioner 470 may absorb variation in dimension of the components and may enable to increase dimensional tolerance.

Fifth Embodiment

Figure 9:
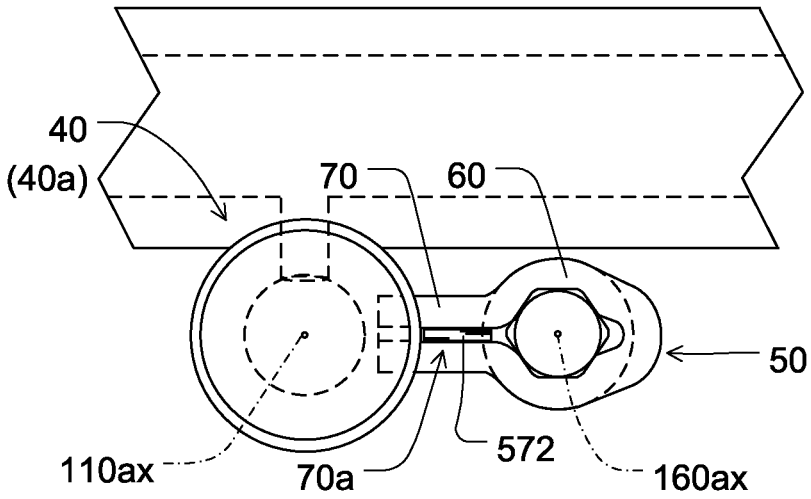
FIG. 9 is a top view showing a injector mounting device according to a fifth embodiment.
Figure 9:
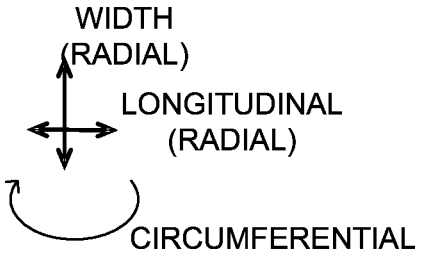
Figure 10:
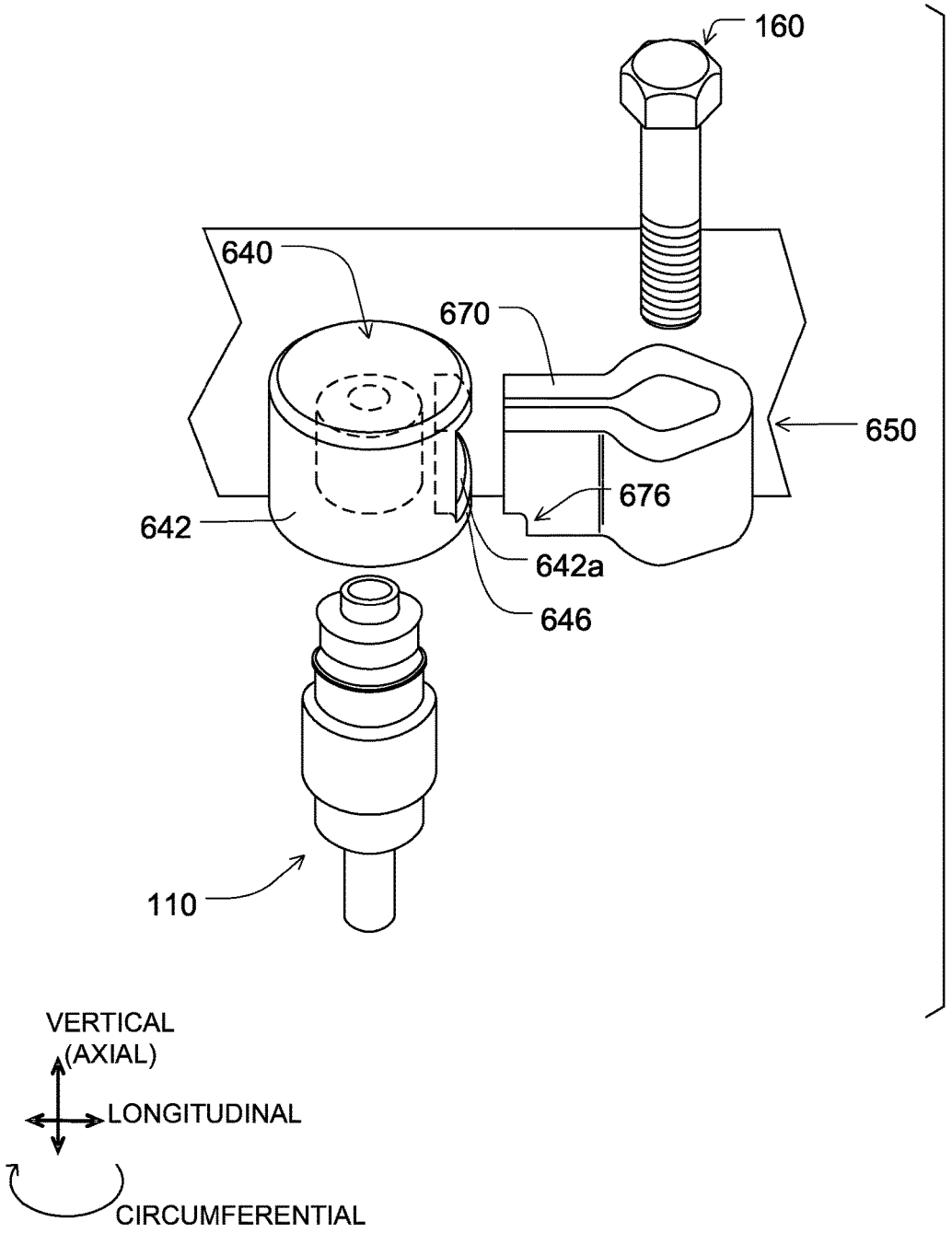
FIG. 10 is an exploded perspective view showing a cup and a bracket according to a sixth embodiment.

As shown in the example of FIG. 9, a dampener 572 may be located in the gap 70*a* between the arms 70. The dampener 572 may be formed of an elastic material such as thermal resistive elastomer. The dampener 572 may be inserted between the arms 70 after the injector mounting device 20 and the fuel rail 10 are brazed and integrated into a single component.

Inner surfaces of the arms 70, which are opposed to each other, may be at an angle relative to each other. That is, the inner surfaces of the arms 70 may be not in parallel with each other. The non-parallel inner surfaces of the arms 70 may reduce resonance caused therebetween.

Sixth Embodiment

As shown in the example of FIG. 9, a cup 640 may have a lower portion 646 defining a lower surface of a key slot 642*a*. Arms 670 of a bracket 650 may have notches 676 correspondingly to the shape of the lower portion 646. The key slot 42*a* may be formed by machining to cut a sidewall 642 to leave the lower portion 646 uncut. The lower portion 646 may support the one end of the arms 670 from the lower side in the vertical direction. The example may enhance mechanical strength of the connection between the cup 640 and the bracket 650.

Other Embodiment

The sidewall of the cup may have two key slots corresponding to the two arms. In this case, the two key slots may receive one ends of the two arms, respectively. The two key slots may have shapes corresponding to the shapes of the one ends of the two arms, respectively.

The features of the above-described embodiments may be arbitrarily combined with each other and/or may be replaced with each other.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An injector mounting device comprising:

a cup in a bottomed tubular shape and configured to receive an injector along an injector axis;

a bracket extended from a sidewall of the cup, wherein the bracket includes at least one arm and a body, the at least one arm connects the body with the cup, the body forms a screw opening configured to receive a screw along a screw axis, the body has a pivot end on an opposite side of the screw axis from the injector axis; wherein the body and the screw opening are asymmetric relative to the screw axis and the body is elongated on a side of the pivot end away from the injector axis, the body has an arm-side end connected with the at least one arm, the screw axis is at a distance L1 from the arm-side end, the screw axis is at a distance L2 from the pivot end, and the distance L2 is greater than the distance L1, the bracket is in a U-shape, the at least one arm includes two arms defining a gap therebetween, the body is in a C-shape having two arm-side ends connected with the arms respectively, the cup has a bottom end and the sidewall, the sidewall has at least one key slot receiving one end of the at least one arm, the at least one key slot is dented radially inward from a surface of the sidewall, the at least one key slot is in a rectangular shape corresponding to a shape of one end of the at least one arm; and a dampener is located in a gap between the arms.

2. The injector mounting device of claim 1, wherein the body is in a partial tubular shape having a notch opening to form a C-shaped section, each of the arms is in a plate shape, and the arms extend from the arm-side ends to form the gap extending from the notch opening.

3. The injector mounting device of claim 1, wherein the body has a bottom surface being a flat surface, the body has a top surface being a flat surface, and the bottom surface and the top surface are in parallel with each other.

4. The injector mounting device of claim 1, wherein the body has a body width W1, the at least one arm has an arm width W2, and the body width W1 is greater than or equal to the arm width W2.

5. The injector mounting device of claim 1, wherein the screw axis and the injector axis are in parallel with each other.

6. The injector mounting device of claim 1, wherein the at least one arm is reduced in cross sectional area relative to the body.

7. The injector mounting device of claim 6, wherein the at least one arm is reduced in size in both a width direction and a height direction.

8. The injector mounting device of claim 1, wherein the at least one arm has a through hole extending in a width direction.

9. The injector mounting device of claim 1, wherein the screw axis is at a distance L3 from an injector axis, the screw axis is at a distance L4 from the pivot end, and the distance L1, the distance L3, and the distance L4 have the following relation: $L1<L4\leq L3$.

10. The injector mounting device of claim 1, further comprising:

a positioner fixed to a top surface of the body, and the positioner is configured to function as a washer to receive the screw.

11. The injector mounting device of claim 10, wherein the positioner has an inner aperture having an inner diameter, which is substantially same as an outer diameter of a stud of the screw.

12. The injector mounting device of claim 1, wherein the bracket is monolithic.

13. A fuel rail comprising:

a rail body in a tubular shape; and an injector mounting device equipped to the rail body, wherein the injector mounting device include a cup and a bracket, the cup is in a bottomed tubular shape and configured to receive an injector along an injector axis, the bracket is extended from a sidewall of the cup, the bracket includes at least one arm and a body, the at least one arm connects the body with the cup, the body forms a screw opening configured to receive a screw along a screw axis, and the body has a pivot end on an opposite side of the screw axis from the injector axis wherein the body and screw opening are asymmetric relative to the screw axis and the body is elongated on a side of the pivot end away from the injector axis, the body has an arm-side end connected with the at least one arm, the screw axis is at a distance L1 from the arm-side end, the screw axis is at a distance L2 from the pivot end, and the distance L2 is greater than the distance L1, the bracket is in a U-shape, the at least one arm includes two arms defining a gap therebetween, the body is in a C-shape having two arm-side ends connected with the arms respectively, the cup has a bottom end and the sidewall, the sidewall has at least one key slot receiving one end of the at least one arm, the at least one key slot is dented radially inward from a surface of the sidewall, the at least one key slot is in a rectangular shape corresponding to a shape of one end of the at least one arm; and a dampener is located in a gap between the arms.

14. The injector mounting device of claim 13, wherein the bracket is extended from the sidewall of the cup along the rail body.

15. The injector mounting device of claim 14, wherein the cup is cantilevered from the rail body, the bracket is cantilevered from the cup, and the bracket is supported by the rail body via the cup.

* * * * *